US006626755B1

(12) United States Patent
Klenke et al.

(10) Patent No.: US 6,626,755 B1
(45) Date of Patent: Sep. 30, 2003

(54) LASERABLE FOLD OVER CARBONLESS FORM

(75) Inventors: Joseph L. Klenke, Kettering, OH (US); Dale Lakes, Dayton, OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/629,294

(22) Filed: Jul. 31, 2000

(51) Int. Cl.[7] ..... B65D 27/06

(52) U.S. Cl. ..... 462/28; 229/69; 229/70; 229/71; 229/72; 229/92.1; 229/301; 229/305; 281/2; 281/5; 281/9; 281/12; 281/13; 283/61; 283/62; 283/101; 462/62; 462/63; 462/66; 462/67; 462/68

(58) Field of Search ..... 281/2, 5, 9, 12, 281/13; 283/61, 62, 101; 229/69, 70, 71, 72, 92.1, 301, 305; 462/62, 63, 66, 67, 68, 28

(56) References Cited

U.S. PATENT DOCUMENTS

| | | | | | |
|---|---|---|---|---|---|
| 2,209,951 | A | | 8/1940 | Pritzker | |
| 2,362,101 | A | * | 2/1944 | Shields | 462/69 |
| 2,503,680 | A | | 4/1950 | Newman | |
| 4,036,511 | A | | 7/1977 | Maalouf | |
| 4,996,184 | A | | 2/1991 | Bevan et al. | |
| 5,137,494 | A | * | 8/1992 | Schubert et al. | 462/68 |
| 5,154,668 | A | * | 10/1992 | Schubert | 462/25 |
| 5,161,735 | A | | 11/1992 | Bendel | |
| 5,197,922 | A | | 3/1993 | Schubert | |
| 5,224,897 | A | * | 7/1993 | Linden et al. | 462/24 |
| 5,238,178 | A | | 8/1993 | Hutchinson et al. | |
| 5,248,279 | A | | 9/1993 | Linden et al. | |
| 5,253,798 | A | | 10/1993 | Lombardo | |
| 5,294,041 | A | * | 3/1994 | Whiteside | 229/69 |
| 5,376,048 | A | * | 12/1994 | Whiteside | 462/6 |
| 5,393,265 | A | | 2/1995 | Linden et al. | |
| 5,395,288 | A | | 3/1995 | Linden et al. | |
| 5,435,600 | A | | 7/1995 | Griffiths et al. | |
| 5,776,571 | A | | 7/1998 | Michlin et al. | |
| 5,913,725 | A | | 6/1999 | Goldring | |
| 5,941,451 | A | | 8/1999 | Dexter | |
| 6,123,253 | A | * | 9/2000 | Mehta et al. | 229/92.1 |
| 6,158,651 | A | * | 12/2000 | Mehta et al. | 462/24 |
| 6,322,106 | B1 | * | 11/2001 | Mehta et al. | 281/2 |

FOREIGN PATENT DOCUMENTS

| | | |
|---|---|---|
| BE | 1010066 A3 | 12/1997 |
| BE | 1010144 A6 | 1/1998 |

* cited by examiner

*Primary Examiner*—A. L. Wellington
*Assistant Examiner*—Mark T. Henderson
(74) *Attorney, Agent, or Firm*—Killworth, Gottman, Hagan & Schaeff, L.L.P.

(57) ABSTRACT

A carbonless form is provided that may be folded selectively into a duplicating state or a non-duplicating state. In accordance with one embodiment of the present invention, a carbonless form is provided comprising a form sheet, a transverse fold line, an assigned data entry portion, and an exposed data entry portion. The form sheet defines a front face, a rear face, a top edge, a bottom edge, and a pair of side edges. The transverse fold line extends across the form sheet to define a first panel and a second panel on opposite sides of the transverse fold line. The assigned data entry portion is defined on the rear face of the second panel. The exposed data entry portion is defined on the front face of the first panel. A CB coating is applied to the rear face of the form sheet in the first panel and a CF coating is applied to the rear face of the form sheet in the second panel. The transverse fold line, the CB coating, and the CF coating are arranged such that the form sheet may be folded selectively about the transverse fold line into either a duplicating or a non-duplicating state. The duplicating state is characterized by juxtaposition of the CB and the CF coating. The non-duplicating state defines a common printing face including the assigned data entry portion of the second panel rear face and the exposed data entry portion of the first panel front face.

15 Claims, 4 Drawing Sheets

LASERABLE FOLD OVER CARBONLESS FORM

CROSS-REFERENCE TO RELATED APPLICATIONS

This application is related to commonly assigned U.S. patent application Ser. No. 09/093,218, BUSINESS FORM OR MAILER WITH CARBONLESS IMAGING, filed Jun. 8, 1998; and U.S. Ser. No. 09/496,772, BUSINESS FORM OR MAILER WITH CARBONLESS IMAGING, filed Feb. 3, 2000.

BACKGROUND OF THE INVENTION

The present invention relates to carbonless copy forms and, more particularly, a carbonless copy form that may be arranged in a non-duplicating state for passage through a laser printer, or some other type of non-impact printer.

Carbonless copy forms are well known. A typical two-part carbonless copy form includes a top sheet having a coated back (CB) containing a colorless micro-encapsulated dye, and a bottom sheet having a coated front (CF) containing a reactive dye-revealing substance. The top and bottom sheets are secured to each other in a duplicating state characterized by juxtaposition of said CB and said CF coatings. In this manner, the pressure of writing on the front surface of the top sheet ruptures the micro-capsules on the CB-coated back surface of the top sheet, releasing dye onto the CF-coated front surface of the bottom sheet, whereupon the writing is revealed in contrasting color on the front surface of the bottom sheet.

Multiple carbonless copies may be produced in a similar manner by assembling one or more intermediate sheets between the CB top and CF bottom sheets. Each of the intermediate sheets has a carbonless front (CF) coating on its front surface for revealing the dye from the previous sheet, and has a carbonless back (CB) coating on its back surface for releasing dye to the next sheet in the set. With these techniques, one or more carbonless copies of information entered on the front surface of an original or top sheet can be reproduced on a corresponding surface of the copy sheet(s).

The chemistry of the CB (image-transferring) and CF (image-revealing) coatings is well known, as are techniques for applying these coatings to paper stock. These coatings and techniques include various coatings applied to paper stock at the mill, as it is being produced, and coatings applied later (typically during the printing process) to plain paper stock. For the purposes of defining and describing the present invention, it is noted that the particular chemistry of the CB and CF coatings utilized according to the present invention is not the subject of the present invention. Rather, the symbols CF and CB merely refer to respective coatings that, when applied to opposing ply faces and subjected to an impression across one of the plies, create a visible duplication of the pattern defined by the impression.

Many of the conventional carbonless copy forms are not well-suited for printing applications. For example, if a user of the form wishes to route the form through a laser printer or other printing device, inadvertent CF surface smudging or marking is likely to occur. Many conventional carbonless copy forms have not adequately addressed these shortcomings. Accordingly, there is a need for a carbonless copy form that may be routed through a printer or imaging device without being subject to inadvertent CF smudging or marking. In addition, many conventional carbonless copy forms do not provide a convenient means by which duplicate data may be created, separated from the original form, and routed. Accordingly, there is also a need for a carbonless copy form that provides an effective means by which duplicate data may be created on a physical form, physically separated from the original data, and made available for routing apart from the form bearing the original data.

BRIEF SUMMARY OF THE INVENTION

This need is met by the present invention wherein a carbonless form is provided that may be folded selectively into a duplicating state or a non-duplicating state. In accordance with one embodiment of the present invention, a carbonless form is provided comprising a form sheet, a transverse fold line, an assigned data entry portion, and an exposed data entry portion. The form sheet defines a front face, a rear face, a top edge, a bottom edge, and a pair of side edges. The transverse fold line extends across the form sheet to define a first panel and a second panel on opposite sides of the transverse fold line. The assigned data entry portion is defined on the rear face of the second panel. The exposed data entry portion is defined on the front face of the first panel.

A CB coating is applied to the rear face of the form sheet in the first panel and a CF coating is applied to the rear face of the form sheet in the second panel. The transverse fold line, the CB coating, and the CF coating are arranged such that the form sheet may be folded selectively about the transverse fold line into either a duplicating or a non-duplicating state. The duplicating state is characterized by juxtaposition of the CB and the CF coating. The non-duplicating state defines a common printing face including the assigned data entry portion of the second panel rear face and the exposed data entry portion of the first panel front face.

The common printing face defined by the form folded in the non-duplicating state preferably extends along the second panel rear face from the transverse fold line to the top edge of the form sheet and along the first panel front face from a line demarcated in the first panel front face by the top edge of the form sheet to the bottom edge of the form sheet. The exposed data entry portion may be defined on the first panel front face between the demarcated line and the bottom edge of the form sheet. The non-duplicating state is characterized by arrangement of the exposed data entry portion outside of the bounds of the second panel.

The first panel front face preferably includes additional data entry portions, the second panel rear face preferably includes duplicate data entry portions, and the form folded in the duplicating state is preferably characterized by alignment of the additional data entry portions and the duplicate data entry portions. In this manner, data entered in the additional data entry portions are reproduced as duplicate data in the duplicate data entry portions. The carbonless form may comprise a physician order form where the assigned data entry portion and the exposed data entry portion comprise patient data entry portions and where the additional data entry portion comprises a physician order entry portion.

The first panel front face may include a plurality of successive apertures formed therein, the second panel rear face may include successive symbols printed thereon, and the form folded in the duplicating state may be characterized by alignment of respective ones of the successive apertures and the successive symbols. In this manner, respective ones of the successive symbols are visible through the successive apertures. The second panel may includes perforated sub-panels defined by transverse perforations in the second panel and respective ones of the successive symbols may be provided on respective ones of the perforated sub-panels.

In accordance with another embodiment of the present invention, a method of processing a carbonless form is provided. The method comprises the steps of: (i) folding the carbonless form into the non-duplicating state; (ii) printing a first set of data in the assigned data entry portion and the exposed data entry portion on the common printing face with the form in the non-duplicating state; (iii) folding the carbonless form into the duplicating state; and (iv) printing a second set of data on the first panel front face with the form in the duplicating state so as to duplicate the second set of data on the second panel second face. A portion of the first set of data entered in the assigned data entry portion preferably bears substantially the same information as a portion of the first set of data entered in the exposed data entry portion.

The first panel front face may include additional data entry portions. The second panel rear face may include duplicate data entry portions. The form may be folded in the duplicating state such that it is characterized by alignment of the additional data entry portions and the duplicate data entry portions. The second set of data may be printed in the additional data entry portions and duplicated in the duplicate data entry portions. The carbonless form may comprise a physician order form wherein the assigned data entry portion and the exposed data entry portion comprise patient data entry portions and the additional data entry portion comprise a physician order entry portion. The method may comprise the step of printing patient data in the patient data entry portions and printing physicians orders in the physician order entry portion.

The second panel may include perforated sub-panels defined by transverse perforations in the second panel and the method of processing the carbonless form may further comprise the steps of: (i) printing the second set of data on the first panel front face with the form in the duplicating state so as to duplicate the second set of data on the second panel second face in a selected one of the perforated sub-panels; and (ii) removing the selected perforated sub-panel by tearing the sub-panel along one of the transverse perforations.

The first panel front face may include a plurality of successive apertures formed therein and the second panel rear face may include successive symbols printed thereon. The form folded in the duplicating state may be characterized by alignment of respective ones of the successive apertures and the successive symbols, the second panel may include perforated sub-panels defined by transverse perforations in the second panel. In this manner, respective ones of the successive symbols may be provided on respective ones of the perforated sub-panels and the method of processing the carbonless form may further comprise the steps of: (i) identifying a valid additional data entry portion on the first panel front face by locating one of the successive symbols corresponding to the valid additional data entry portion; (ii) printing the second set of data in the valid additional data entry portion with the form in the duplicating state so as to duplicate the second set of data on the second panel second face in a selected one of the perforated sub-panels; and (iii) removing the selected perforated sub-panel by tearing the sub-panel along one of the transverse perforations.

The step of removing the selected perforated sub-panel preferably invalidates an additional data entry portion on the first panel front face and the method may further comprise the steps of: (i) identifying a remaining valid additional data entry portion on the first panel front face by locating one of the successive symbols corresponding to the remaining valid additional data entry portion; (ii) printing the second set of data in the remaining valid additional data entry portion with the form in the duplicating state so as to duplicate the second set of data on the second panel second face in a selected remaining one of the perforated sub-panels; and (iii) removing the remaining selected perforated sub-panel by tearing the sub-panel along one of the transverse perforations.

Accordingly, it is an object of the present invention to provide a carbonless form that may be pre-printed without the risk of smudging or marking the CF face. Further, it is an object of the present invention to provide a carbonless form that provides an effective means by which duplicate data may be created on a physical form, physically separated from the original data, and made available for routing apart from the form bearing the original data. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
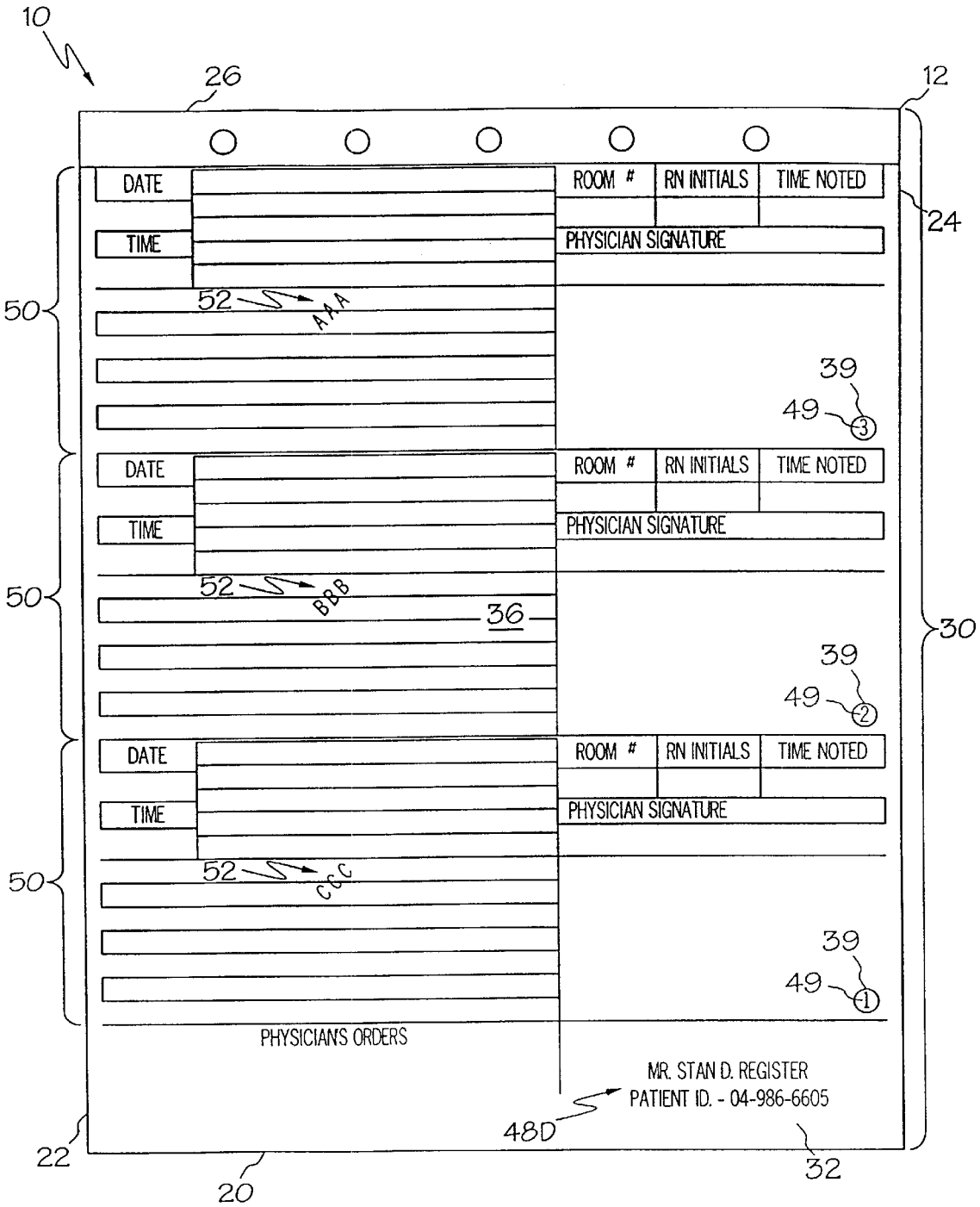
FIG. 1 is an illustration of a carbonless form according to the present invention folded into a duplicating state.

Referring collectively to FIGS. 1–4, a carbonless form 10 is provided comprising a form sheet 12 defining a front face 14, a rear face 16, a top edge 18, a bottom edge 20, and a pair of side edges 22, 24. The front face 14 and rear face 16 are most clearly illustrated in FIGS. 3 and 4. A transverse fold line 26 extends across the form sheet 12 to define a first panel 30 and a second panel 40 on opposite sides of the transverse fold line 26. An exposed data entry portion 32 is defined on the front face 14 of the first panel 30. An assigned data entry portion 42 is defined on the rear face 16 of the second panel 40.

Figure 2:
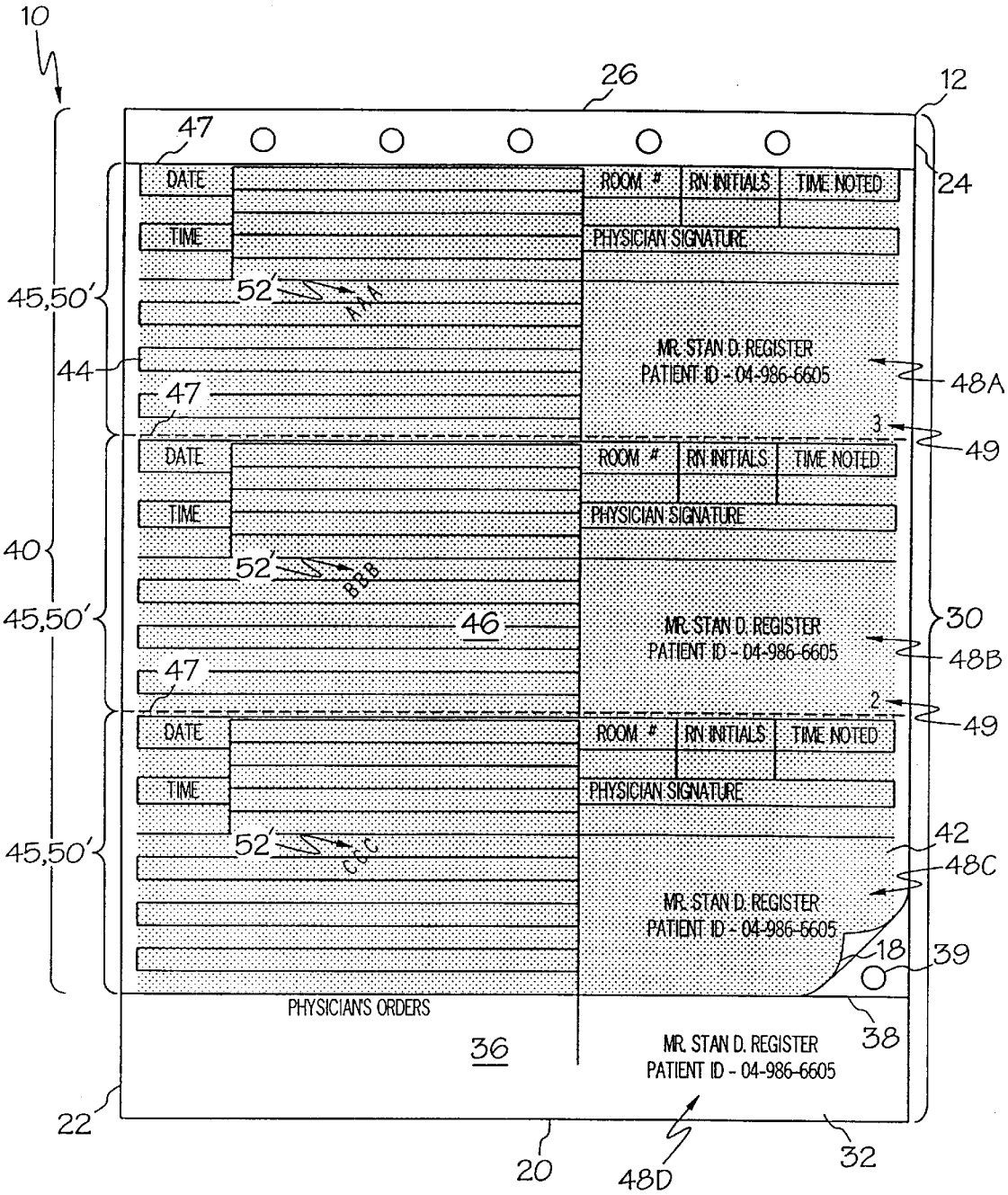
FIG. 2 is an illustration of a carbonless form according to the present invention folded into a non-duplicating state.
Figure 3:
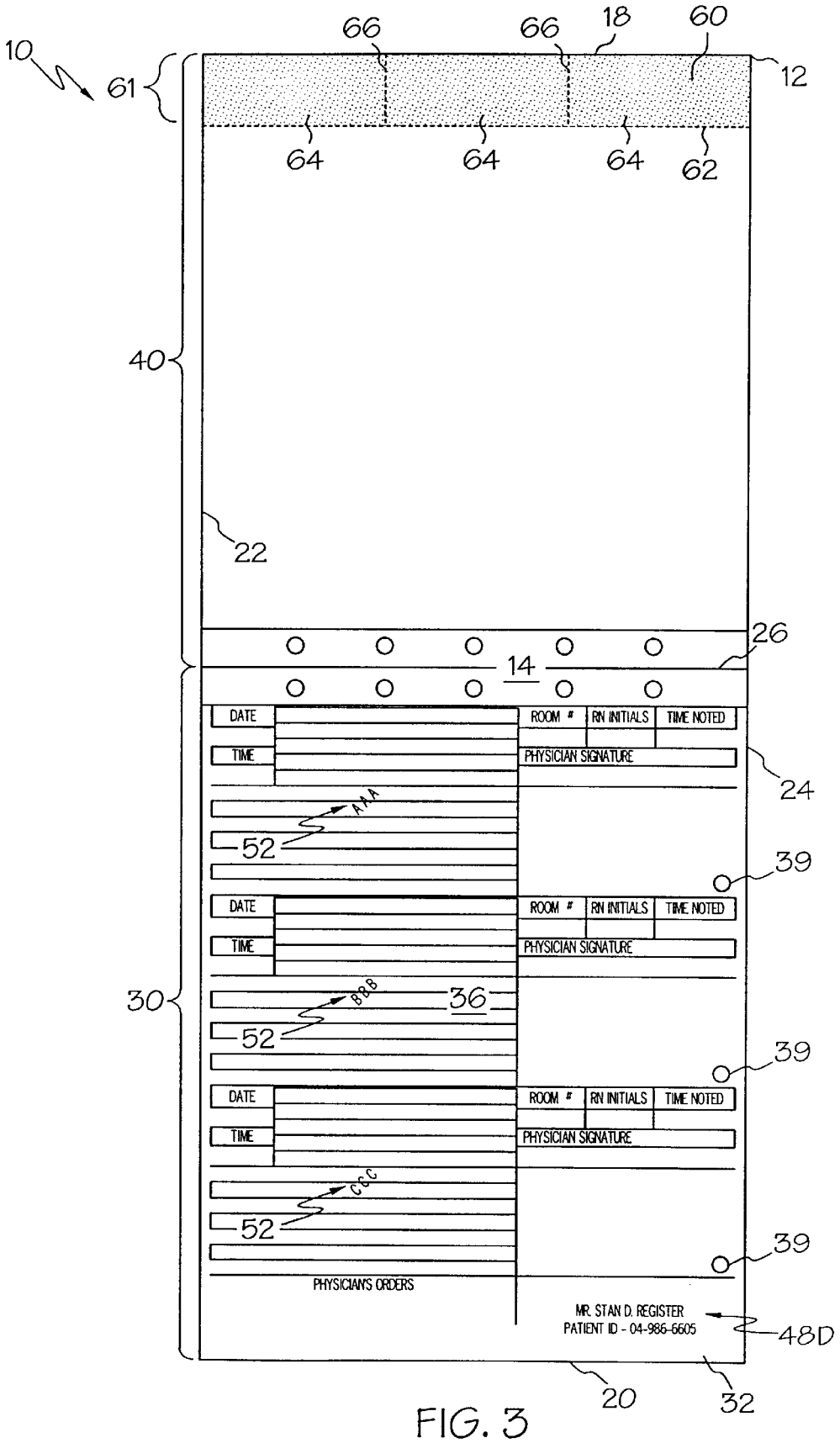
FIG. 3 is an illustration of a front face of an unfolded carbonless form according to the present invention.

A CB coating 34 is applied to the rear face 16 of the form sheet 12 in the first panel 30. A CF coating 44 is applied to the rear face 16 of the form sheet 12 in the second panel 40. The transverse fold line 26, the CB coating 34, and the CF coating 44 are arranged such that the form sheet 12 may be folded selectively about the transverse fold line 26 into either a duplicating or a non-duplicating state. The duplicating state is illustrated in FIG. 1 and is characterized by juxtaposition or abutment of the CB and the CF coatings 34, 44. The non-duplicating state is illustrated in FIG. 2 and defines a common printing face including the assigned data entry portion 42 of the rear face 16 of the second panel 40 and the exposed data entry portion 32 of the front face 14 of the first panel 30. The rear face 16 of the second panel 40 is identified herein as the second panel rear face 46 and the front face 14 of the first panel 30 is identified herein as the first panel front face 36.

The common printing face defined by the form 10 folded in the non-duplicating state of FIG. 2 extends along the second panel rear face 46 from the transverse fold line 26 to the top edge 18 of the form sheet 12 and along the first panel front face 36 from a line 38 demarcated in the first panel front face 36 by the top edge 18 of the form sheet 12 to the bottom edge 20 of the form sheet 12. The exposed data entry portion 32 is defined on the first panel front face 36 between the demarcated line 38 and the bottom edge 20 of the form sheet 12. In this manner, the form 10 may be passed through a printer in the non-duplicating state of FIG. 2 and a single pass image may be printed on both the first and second panels 30, 40 because the common printing face includes both the assigned data entry portion 42 and the exposed data entry portion 32.

For example, because the exposed data entry portion 32 is arranged outside of the bounds of the second panel 40, common sets of identifying data 48A, 48B, 48C, 48D may be printed in the assigned data entry portion 42 and the exposed data entry portion 32 in a single pass printing operation even though the assigned data entry portion 42 and the exposed data entry portion 32 are present on distinct panels 30, 40 of the form 10. Accordingly, the common sets of identifying data 48A, 48B, 48C, 48D may be printed on both panels 30, 40 of the form 10 when the form is arranged in the non-duplicating state. In this manner, the present invention eliminates inadvertent smudging or marking from impressions made by the particular printer used to print the common sets of identifying data 48A, 48B, 48C, 48D.

The first panel front face 36 includes additional data entry portions 50 and the second panel rear face 46 includes duplicate data entry portions 50' (see FIGS. 1 and 2). The form 10 folded in the duplicating state is characterized by alignment of the additional data entry portions 50 and the duplicate data entry portions 50'. In this manner, data 52 entered in the additional data entry portions 50 are reproduced as duplicate data 52' in the duplicate data entry portions 50'. In a specific embodiment of the present invention, the carbonless form 10 comprises a physician order form, the assigned data entry portion 42 and the exposed data entry portion 32 comprise patient data entry portions, and the additional data entry portion 50 comprises a physician order entry portion.

As will be appreciated by those practicing the present invention, when the form is folded into the duplicating state, see FIG. 1, the set of identifying data 48D printed in the exposed data entry portion 32 remains visible from the outside of the form 10. The remaining sets of identifying data are on the interior of the form 10, printed on the second panel rear face 46 with the duplicate data entry portions 50' and any duplicate data 52'.

Figure 4:
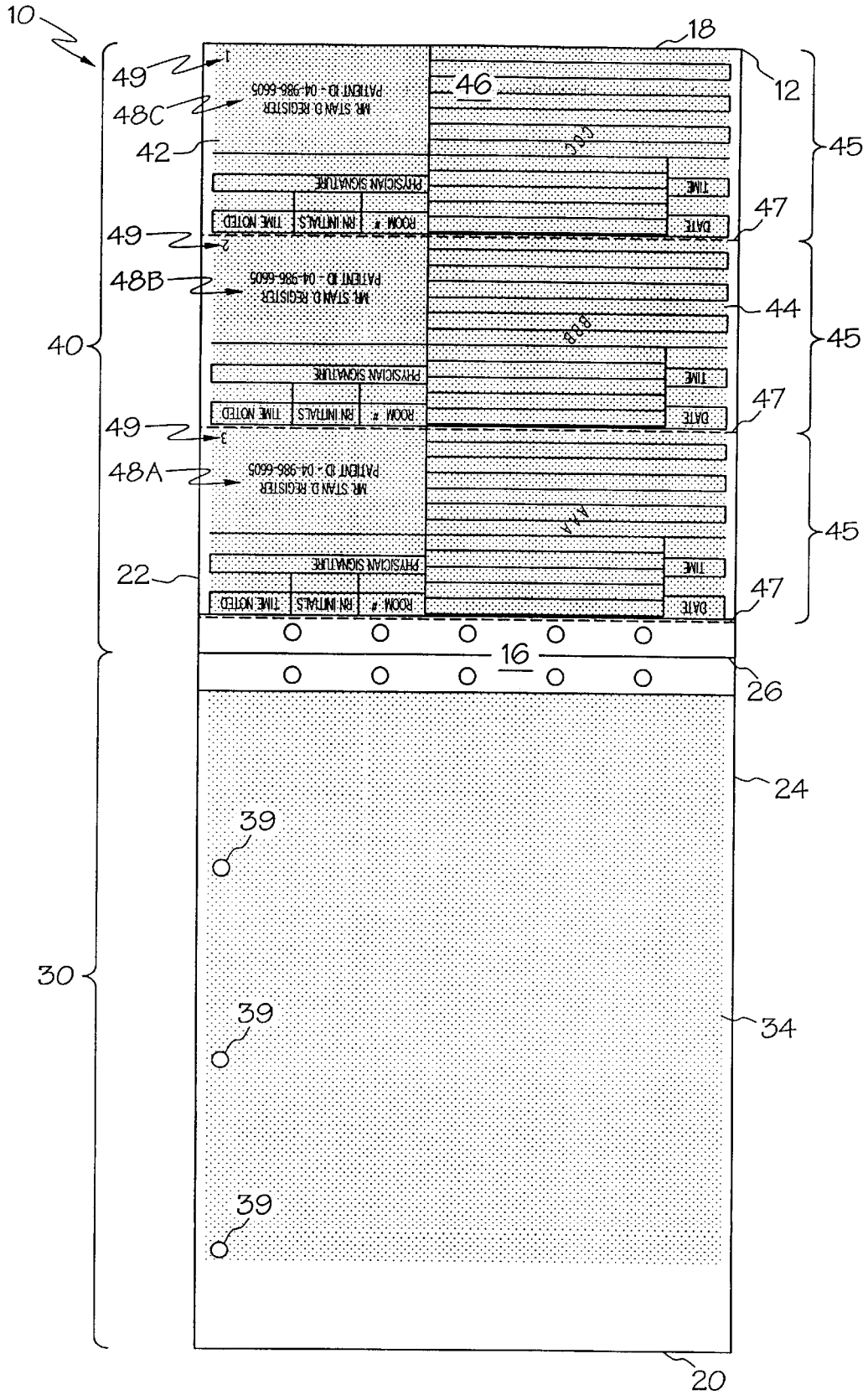
FIG. 4 is an illustration of a rear face of an unfolded carbonless form according to the present invention.

As is illustrated in FIGS. 2 and 4, the second panel 40 includes perforated sub-panels 45 defined by transverse perforations 47 in the second panel 40. Each of the perforated sub-panels 45 includes one of a series of successive numbers or symbols 49 printed thereon. The first panel front face 36 includes a plurality of successive apertures 39 formed therein. When the form is folded in the duplicating state, see FIG. 1, the successive numbers 49 are aligned with the respective corresponding apertures 39 so that each number 49 is visible through its corresponding aperture 39. The presence or absence of one or more of the successive numbers 49 in a corresponding aperture provides an indication as to whether any of the sub-panels 45 have been removed from the form 10 and an indication as to how many sub-panels 45 remain attached to the form 10.

As can be appreciated from the above description of the present invention, the carbonless form 10 of the present invention may be pre-printed by ensuring that the form 10 is folded in the non-duplicating configuration and by passing the form 10 through a printing device programmed to print predetermined data, e.g., the common sets of identifying data 48A, 48B, 48C, 48D, in the assigned data entry portion 42 and the exposed data entry portion 32 of the form 10. In some embodiments of the present invention, the form 10 may merely be a blank sheet and the pre-printing operation may consist of printing graphical data, symbols, etc., in addition to the common sets of identifying data 48A, 48B, 48C, 48D.

After pre-printing, the form 10 may be folded into the duplicating configuration illustrated in FIG. 1 and prepared for use in a specific duplicating application. For example, the form 10 may be used as a physician order form. Typically, the physician order form 10 will carry pre-printed data 48A, 48B, 48C, 48D identifying a patient and any patient-related information. Physician orders, illustrated generally as data 52, are sequentially entered, by hand printing or otherwise, in successive additional data entry portions 50 of the first panel front face 36. As a specific order is completed, the perforated sub-panel 45 bearing the duplicate data 52' is removed from the form 10 to enable processing of the physician order. The original order data 52 remains with the order form 10, which is typically maintained with the patient's chart. Successive physician orders are processed in a similar manner, until each of the additional data entry portions 50 have been utilized.

Referring again to FIG. 3, the carbonless form 10 of the present invention may be provided with a repositionable adhesive 60 positioned in an upper portion 61 of the second panel 40 front face 14 along the top edge 18 to secure the first panel 30 to the second panel 40 when the form 10 is folded in the non-duplicating state of FIG. 2. This upper portion 61 of the form 10 may also be provided with a set of transverse perforations 62 to enable removal of the repositionable adhesive 60. In addition, detachable and repositionable label portions 64 may be formed in the upper portion 61 by providing sets of auxiliary perforations 66 therein.

It is contemplated that the carbonless form 10 of the present invention may be utilized in a variety of applications in addition to the physician order form application discussed herein. In any application, the form of the present may be pre-printed without the risk of smudging or marking the CF face. Further, the form of the present invention provides an effective means by which duplicate data may be created on a physical form, physically separated from the original data, and made available for routing apart from the form bearing the original data. Having described the invention in detail and by reference to preferred embodiments thereof, it will be apparent that modifications and variations are possible without departing from the scope of the invention defined in the appended claims.

What is claimed is:

1. A carbonless form comprising:

a form sheet defining a front face, a rear face, a top edge, a bottom edge, and a pair of side edges;

a transverse fold line extending across said form sheet to define a first panel and a second panel on opposite sides of said transverse fold line;

an assigned data entry portion defined on said rear face of said second panel;

an exposed data entry portion defined on said front face of said first panel; and a CB coating applied to said rear face of said form sheet in said first panel and a CF coating applied to said rear face of said form sheet in said second panel, wherein said transverse fold line, said CB coating, and said CF coating are arranged such that said form sheet may be folded selectively about said transverse fold line into one of a folded duplicating and a folded non-duplicating state, said folded duplicating state is characterized by juxtaposition of said CB and said CF coating, and said folded non-duplicating state defines a common printing face which includes said assigned data entry portion of said second panel rear face and said exposed data entry portion of said first panel front face.

2. A carbonless form as claimed in claim 1 wherein said common printing face defined by said form folded in said non-duplicating state extends along said second panel rear face from said transverse fold line to said top edge of said form sheet and along said first panel front face from a line demarcated in said first panel front face by said top edge of said form sheet to said bottom edge of said form sheet.

3. A carbonless form as claimed in claim 2 wherein said exposed data entry portion is defined on said first panel front face between said demarcated line and said bottom edge of said form sheet.

4. A carbonless form as claimed in claim 1 wherein said first panel defines a periphery and said second panel defines a periphery and wherein said non-duplicating state is characterized by arrangement of said exposed data entry portion outside of the periphery of said second panel.

5. A carbonless form as claimed in claim 1 wherein said first panel front face includes additional data entry portions, said second panel rear face includes duplicate data entry portions, and said form folded in said duplicating state is characterized by alignment of said additional data entry portions and said duplicate data entry portions, whereby data entered in said additional data entry portions are reproduced as duplicate data in said duplicate data entry portions.

6. A carbonless form as claimed in claim 5 wherein said carbonless form comprises a physician order form, said assigned data entry portion and said exposed data entry portion comprise patient data entry portions, and said additional data entry portion comprises a physician order entry portion.

7. A carbonless form as claimed in claim 1 wherein said carbonless form comprises a physician order form and said assigned data entry portion and said exposed data entry portion comprise patient data entry portions.

8. A carbonless form as claimed in claim 1 wherein said first panel front face includes a plurality of successive apertures formed therein, said second panel rear face includes successive symbols printed thereon, and said form folded in said duplicating state is characterized by alignment of respective ones of said successive apertures and said successive symbols, whereby respective ones of said successive symbols are visible through said successive apertures.

9. A carbonless form as claimed in claim 8 wherein said second panel includes perforated sub-panels defined by transverse perforations in said second panel and wherein respective ones of said successive symbols are provided on respective ones of said perforated sub-panels.

10. A carbonless form as claimed in claim 1 wherein said second panel includes perforated sub-panels defined by transverse perforations in said second panel.

11. A carbonless form as claimed in claim 10 wherein respective ones of said perforated sub-panels include respective ones of a set of successive symbols printed thereon.

12. A carbonless form as claimed in claim 1 further comprising a repositionable adhesive positioned on said second panel front face along said top edge.

13. A carbonless form as claimed in claim 12 wherein said repositionable adhesive is provided in an upper portion of said second panel front face between said top edge and a set of transverse perforations.

14. A carbonless form as claimed in claim 13 further comprising detachable and repositionable label portions defined in said upper portion by at least one set of auxiliary perforations.

15. A carbonless physician order form comprising:

a form sheet defining a front face, a rear face, a top edge, a bottom edge, and a pair of side edges;

a transverse fold line extending across said form sheet to define a first panel and a second panel on opposite sides of said transverse fold line;

an assigned patient data entry portion defined on said rear face of said second panel;

an exposed patient data entry portion defined on said front face of said first panel; and a CB coating applied to said rear face of said form sheet in said first panel and a CF coating applied to said rear face of said form sheet in said second panel, wherein said transverse fold line, said CB coating, and said CF coating are arranged such that said form sheet may be folded selectively about said transverse fold line into one of a folded duplicating and a folded non-duplicating state, said folded duplicating state is characterized by juxtaposition of said CB and said CF coating, said folded non-duplicating state defines a common printing face which includes said assigned patient data entry portion of said second panel rear face and said exposed patient data entry portion of said first panel front face, and said first panel front face includes physician order entry portions, said second panel rear face includes duplicate physician order entry portions, and said form folded in said duplicating state is characterized by alignment of said physician order entry portions and said duplicate physician order entry portions, whereby data entered in said physician order entry portions are reproduced as duplicate data in said duplicate physician order entry portions.

* * * * *